US007770988B2

(12) United States Patent
Saikawa

(10) Patent No.: US 7,770,988 B2
(45) Date of Patent: Aug. 10, 2010

(54) PRINTING APPARATUS AND PRINTING METHOD

(75) Inventor: Takashi Saikawa, Shiojin (JP)

(73) Assignee: Seiko Epson Corporation, Tokyo (JP)

( * ) Notice: Subject to any disclaimer, the term of this patent is extended or adjusted under 35 U.S.C. 154(b) by 388 days.

(21) Appl. No.: 11/340,777

(22) Filed: Jan. 25, 2006

(65) Prior Publication Data

US 2006/0164458 A1 Jul. 27, 2006

(30) Foreign Application Priority Data

Jan. 25, 2005 (JP) ..... 2005-016580

(51) Int. Cl.
*B41J 29/38* (2006.01)
*B41J 2/195* (2006.01)
*B41J 2/21* (2006.01)

(52) U.S. Cl. ..... 347/9; 347/7; 347/43

(58) Field of Classification Search ..... 347/7, 347/9, 43

See application file for complete search history.

(56) References Cited

U.S. PATENT DOCUMENTS 6,352,327 B1 * 3/2002 Yano et al. ..... 347/14
6,533,393 B1 3/2003 Meyer et al.
2004/0041855 A1 3/2004 Fujikawa et al.
2005/0035995 A1 * 2/2005 Yazawa et al. ..... 347/43

FOREIGN PATENT DOCUMENTS

| | | |
|---|---|---|
| EP | 0 540 987 A2 | 5/1993 |
| EP | 0 916 496 A2 | 5/1999 |
| EP | 0 983 855 A2 | 3/2000 |
| JP | 09011506 | 1/1997 |
| JP | 09-093442 | 4/1997 |
| JP | 11-099670 | 4/1999 |
| JP | 2000-71432 | 3/2000 |
| JP | 2002-171414 | 6/2002 |
| JP | 2002-264361 | 9/2002 |
| JP | 2003-094672 | 4/2003 |

OTHER PUBLICATIONS

European Search Report dated Jul. 25, 2006.

* cited by examiner

*Primary Examiner*—Matthew Luu
*Assistant Examiner*—Jannelle M Lebron
(74) *Attorney, Agent, or Firm*—Nutter McClennen & Fish LLP; John J. Penny, Jr.; Michael P. Visconti, III

(57) ABSTRACT

A printing apparatus including a plurality of ink cartridges each supplying ink; an image processor generates print data for each ink based on input print data; a buffer which stores the print data generated by the image processor for each ink; a print head for discharging the ink supplied from each ink cartridge from a nozzle group for each ink based on the print data for each ink stored in the buffer; and a supply line that supplies print data from the buffer to the print head.

14 Claims, 9 Drawing Sheets

PRINTING APPARATUS AND PRINTING METHOD

BACKGROUND OF THE INVENTION

1. Field of Technology

The present invention relates to a printing apparatus and a printing method that can print using an ink cartridge or other type of cartridges storing a recording medium.

2. Description of Related Art

Inkjet printers can be categorized as monochrome or color printers. A monochrome printer is a printer that prints using only one color of ink, which may be black, red, or other color. A color printer is a printer that can print using two or more colors of ink, such as black and red, black and blue, or other combination of at least two colors. See, for example, Japanese Unexamined Patent Appl. Pub. 2003-94672.

This type of color printer can be used as a compact printer in a point-of-sale (POS) system, for example. Users whose printing needs are met by printing only in black can use a monochrome printer to print receipts and other content. Users that want to print using color, on the other hand, such as to print the store name or logo in red while printing the detailed product lines on a sales receipt in black, do so by using a color printer.

Users with clear current and future printing objectives can select either or both monochrome and color printers according to their intended purpose. Some users, however, are only interested in monochrome printing at the time the printer is purchased but also want the ability to print in color at sometime in the future. Such users can prepare for this future color printing need by purchasing a color printer and using the color printer for monochrome printing.

Color inkjet printers use a separate ink cartridge for each color of ink, and the capacity of each ink cartridge is thus typically less than the ink cartridge capacity in a monochrome printer. As a result, if a color printer is used for monochrome printing using just one color of ink, the ink cartridge will be emptied in less time than if using a monochrome printer and the ink cartridge will thus be replaced more frequently. The user must therefore frequently replace the ink cartridge, and this ink cartridge replacement process can be tedious. Replacing the ink cartridge also interrupts work because the printer cannot print while the ink cartridge is being replaced.

A printing apparatus and printing method according to one embodiment of this invention reduce how frequently the recording medium (such as ink) cartridge must be replaced and thus improve job productivity when using a printer having a plurality of recording medium cartridges as a monochrome printer.

A printing apparatus and printing method according to another embodiment of the invention enable selection of how the recording medium cartridges are used in a plurality of print modes.

A printing apparatus and printing method according to another embodiment of the invention use a plurality of recording medium cartridges evenly by means of a relatively simple control configuration without involving the host device that generates the monochrome print data.

SUMMARY OF THE INVENTION

A printing apparatus according to a first embodiment of the invention has a plurality of ink cartridges each supplying ink; a print data generating means for generating print data for each ink based on input print data; a print data storage means for storing the print data generated by the print data generating means for each ink; a print head for discharging the ink supplied from each ink cartridge from a nozzle group for each ink based on the print data for each ink stored in the print data storage means; and a print data supply means for supplying print data from the print data storage means to the print head. The print data supply means supplies at least a portion of the print data using one of the plurality of inks to the print head as print data using another of the inks.

For ease of understanding, this embodiment of the invention is described briefly below using a first cartridge containing ink of a first color (such as black) and a second cartridge containing a second color (such as red) of ink. The print data generating means receives data to be printed from a personal computer, cash register terminal, or portable terminal device (including even a cell phone), and generates print data for each color of ink based on the data received for printing.

In monochrome printing using only the first color, for example, the print data generating means receives only print data specifying the first color from the host device. Based on this received data, the print data generating means generates print data using only the first color and stores this first color print data to the print data storage means.

The print data supply means supplies the first color print data stored in the print data storage means to the print head. The print head has a nozzle group for printing the first color and a nozzle group for printing a second color. Ink is supplied from the first cartridge to the nozzle group for the first color, and ink is supplied from the second cartridge to the nozzle group for the second color.

Based on the first ink, the print head discharges ink stored in the first cartridge from the nozzles of the first color nozzle group at the specified timing. The print data supply means can supply at least a portion of the first color print data to the print head as second color print data. When second color print data is supplied, the print head discharges the ink in the second cartridge from the nozzle group for the second color at a specific timing.

By using part of the first color print data as second color print data, ink from the first cartridge and ink from the second cartridge can both be used for printing in a monochrome print mode. The first cartridge can thus be replaced less frequently than when only the first cartridge is used for printing.

A printing apparatus according to another embodiment of the invention also has a selection means for selecting a monochrome print mode or a color print mode. When the monochrome print mode is selected, the color of the one ink is the same as the color of the other ink, and the print data supply means supplies to the print head at least a portion of the print data using one of the plurality of inks as print data using another of the plurality of inks. When the color print mode is selected, the color of the one ink and the color of the other ink are different, and the print data supply means supplies print data for each ink directly to the print head.

By thus being able to select a monochrome print mode, a user having a printer having a plurality of ink cartridges and thus capable of printing multiple colors can increase the volume of the one ink (first color ink) used for monochrome printing. If the user later desires color printing, printing in color can be enabled by changing the color of the other ink and selecting the color print mode.

When the monochrome print mode is selected in yet another embodiment of the invention, the print data supply means supplies print data using the one ink stored in the print data storage means to the print head equally as print data using the one ink and print data using another ink.

If the capacity of the one ink cartridge and the capacity of the other ink cartridge are the same, the replacement time of the one ink cartridge and the other ink cartridge can be controlled to substantially the same time.

When the monochrome print mode is selected in yet another embodiment of the invention, the print data supply means supplies print data using the one ink stored in the print data storage means to the print head as print data using the one ink or print data using another ink according to the ratio V1/V2 where V1 is the volume of ink in the ink cartridge supplying the one ink and V2 is the volume of ink in the ink cartridge supplying the other ink.

This makes it possible to control ink consumption so that the ink cartridges must be replaced at substantially the same time even when the capacity of the ink cartridges is not the same.

For example, if V1=V2 (V1/V2=1), the print data supply means supplies the first color ink and the second color print data to the print head in an alternating fashion for every pass of the print head in the main scanning direction as first color print data and second color print data, respectively. More specifically, the print data printed in the first pass is supplied to the print head as first color print data, and the print data printed in the second pass of the print head is supplied to the print head as second color print data. This pattern thereafter repeats so that, for example, the print data is sent to the print head as first color print data for the third pass and as second color print data for the fourth pass, and so on.

Furthermore, if V1 is twice V2 (V1/V2=2), the print data supply means supplies the print data as first color print data to the print head for two passes of the print head, and as second color print data for the third pass of the print head and so on. The cartridge replacement interval can thus be controlled so that both cartridges need replacing at the same time by adjusting the distribution of print data according to the cartridge capacity when the capacity of each ink cartridge is not the same.

A printing apparatus according to another embodiment of the invention also has a remaining level detection means for detecting the amount of ink remaining in each ink cartridge. When the monochrome print mode is selected, the print data supply means supplies print data using one ink stored in the print data storage means to the print head as print data or print data using another ink so that the remaining volume of the one ink and the remaining volume of the other ink are substantially equal.

In this embodiment of the invention the amount of ink remaining in each cartridge is detected at each main scan, and the print data is distributed so that substantially the same amount remains in each cartridge.

If the remaining amount of each ink is managed in stages, specifically a near_end level indicating that the amount of remaining ink has dropped to or below a first specific level and an empty level indicating that the amount of remaining ink is effectively zero, the printing apparatus further preferably has a means of reporting to the user that the amount of ink left in the cartridges is approaching zero.

When the user thus knows that the near_end level has been reached, the user can prepare a replacement cartridge and can replace the cartridge before it becomes empty. Because a certain amount of time is required to go from the near_end level to the empty level, the time when the near_end level is reported for the one and the other ink cartridge can be controlled to substantially the same time, and the user can thus replace both ink cartridges at the same time with little or no waste.

When the monochrome print mode is selected in yet another embodiment of the invention, the print data supply means determines for each main scanning pass of the print head whether to supply to the print head the print data using the one ink stored in the print data storage means to the print head as print data using the one ink or print data using another ink.

Thus limiting deciding whether to switch the print data distribution at each pass of the print head enables the control method of the present invention to be easily achieved.

Another embodiment of the invention is a printing method for printing using a printing apparatus comprising a plurality of ink cartridges and a print head for discharging the ink supplied from each ink cartridge from a nozzle group for each ink, the printing method comprising steps of receiving print data from a host device; generating print data for each ink based on the received print data; storing the generated print data separately for each ink; detecting how much ink remains in each ink cartridge; and supplying at least a portion of a specific amount of print data that uses one ink to the print head as print data that uses the other ink so that the remaining volume of the one ink and the remaining volume of the other ink are substantially equal.

A printing method for printing using a printing apparatus according to another embodiment of the invention also has a step of selecting a monochrome print mode or a color print mode before receiving print data. When the monochrome print mode is selected, the color of the one ink is set to the same as the color of the other ink, and the print data supplying step supplies to the print head at least a portion of a specific amount of the print data using one of the plurality of inks as print data using another of the plurality of inks so that the remaining volume of the one ink and the remaining volume of the other ink are substantially equal. When the color print mode is selected, the color of the one ink and the color of the other ink are different, and the print data supplying step supplies print data for each ink directly to the print head.

Other objects and features together with a fuller understanding of the invention will become apparent and appreciated by referring to the following description and claims taken in conjunction with the accompanying drawings.

DESCRIPTION OF THE PREFERRED EMBODIMENTS

Figure 1:
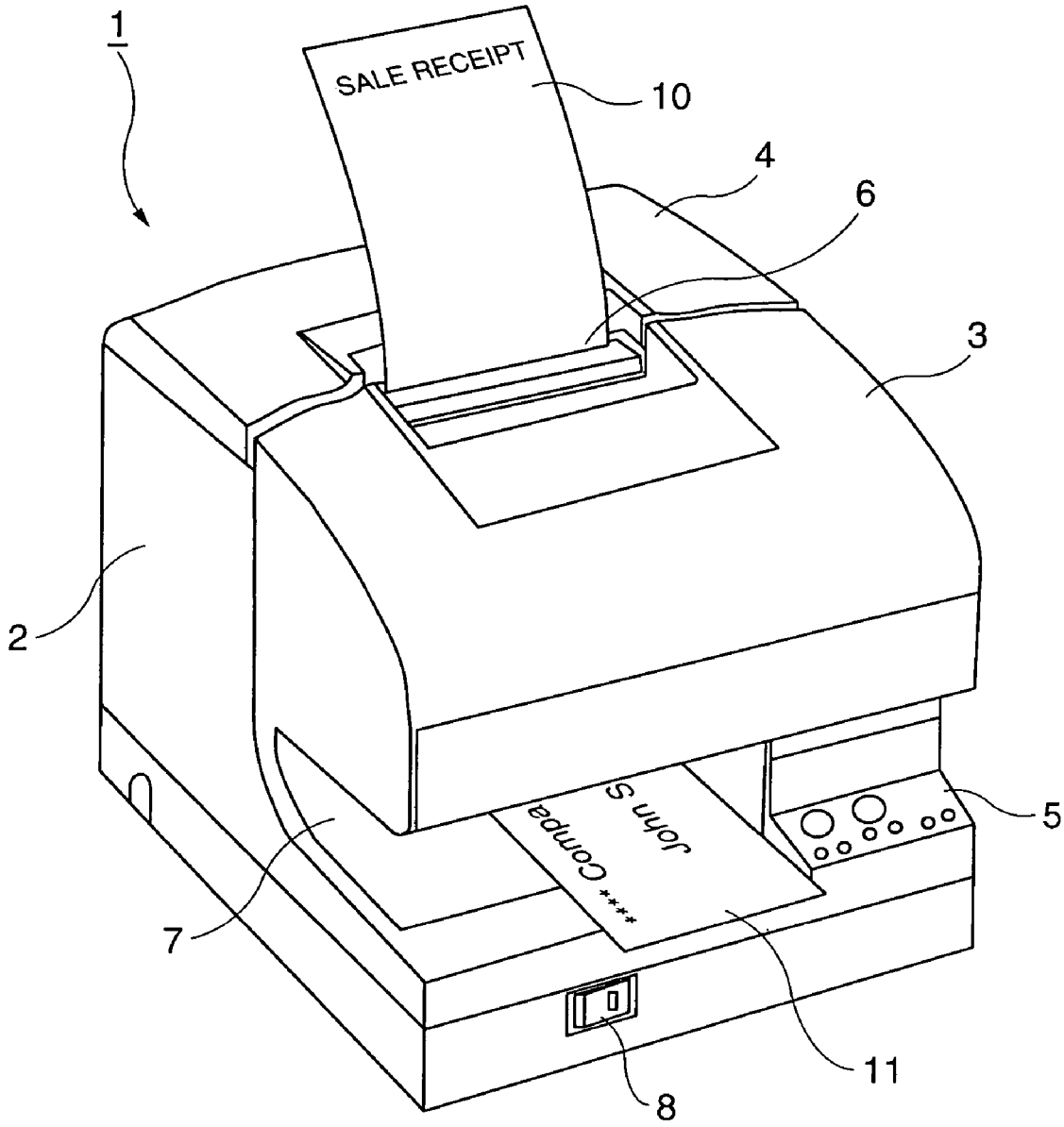
FIG. 1 is an external view showing a printer according to at least one embodiment of the present invention.

Preferred embodiments of the present invention are described in detail below with reference to the accompanying figures. This invention is described below, using by way of example only, a printer having two ink cartridges, but the invention is not limited to printers having two ink cartridges or colors of ink.

Embodiment 1

A printer 1 according to this embodiment of the invention is a multistation printer that can print both roll paper 10 and slips 11 using a common print engine. A front cover 3 and back cover 4 are attached to the case 2 of the printer 1 so that the covers can open and close. Opening covers 3 and 4 enables replacing the ink cartridges 210 and 220 (see FIG. 2) and replacing or adding roll paper 10.

An operating panel 5 that can be expressed as an operating means or a user interface means is provided at the front of the case 2. The user can control feeding paper and head cleaning operations, for example, using buttons and other control elements on the operating panel 5. The user can also know if the paper supply has run out or the ink cartridge is empty, for example, based on the on/off state of indicators also provided in the operating panel 5. A power switch 8 is also disposed at the bottom front of the case 2.

A roll paper exit 6 is disposed at the top of the case 2. The end of the roll paper 10 is externally discharged from this roll paper exit 6. The printed roll paper 10 can be cut either manually by the user or automatically by a paper cutter. This roll paper 10 can be used for printing receipts, for example.

A slip exit 7 is rendered at the front middle part of the case 2. Rectangular slips 11, for example, can be printed and then discharged from this slip exit 7.

It will be obvious to one with ordinary skill in the related art that FIG. 1 shows a printer 1 according to one embodiment of the invention and the invention shall not be limited to such a printer 1. The location of the front cover 3, back cover 4, and operating panel 5, for example, shall not be limited to the arrangement shown in FIG. 1. The ability to print to both roll paper 10 and slips 11 is also not necessary.

Figure 2:
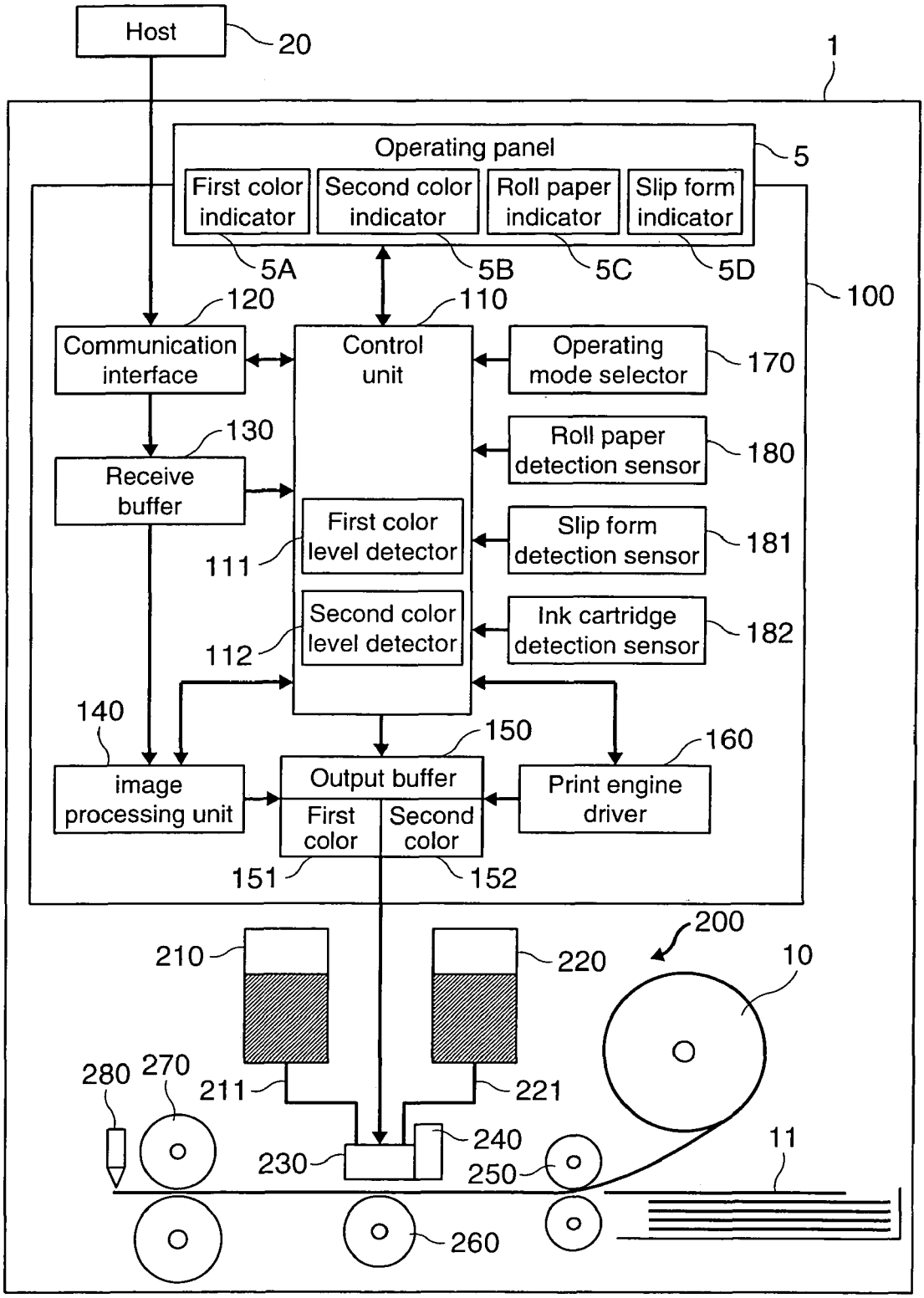
FIG. 2 is a function block diagram of a printer.

FIG. 2 is a function block diagram of the inside of the printer 1. This printer 1 is composed of a printer controller 100 and print engine 200, both of which are described in further detail below.

The printer controller 100 controls printer 1 operation. The printer controller 100 can be rendered as a microcomputer system having a CPU (central processing unit), ROM (read-only memory), RAM (random access memory), and system LSI device, for example.

The functions of the printer controller 100 are handled by a control unit 110, communication interface 120, receive buffer 130, image processing unit 140, output buffer 150, and print engine driver 160.

The printer controller 100 can also exchange data with a host 20 over a USB, IEEE 1394, or other communication interface. The printer controller 100 also exchanges control signals with the operating panel 5.

A plurality of status indicators such as a first color indicator 5A, second color indicator 5B, roll paper indicator SC, and slip form indicator 5D can also be rendered on the operating panel 5. The operating panel 5 causes specific indicators to blink or light steady based on signals from the control unit 110 to report to the user the remaining ink level and whether there is any paper in the printer, for example.

The first color indicator 5A is used to report the remaining ink level in the first ink cartridge 210, and the second color indicator 5B is used to report the remaining ink level in the second ink cartridge 220. Multiple ink levels can be indicated by varying how the indicators 5A and 5B light. If, for example, indicators 5A and 5B are flashing, the user knows that the amount of ink remaining in the cartridge, i.e., the remaining ink level, has dropped to a predetermined near_end level. If the indicators 5A and 5B light steady, the user knows that the remaining ink level has dropped to the empty level where the amount of ink is essentially zero.

The roll paper indicator SC indicates if any roll paper 10 is left, and the slip form indicator 5D indicates if a slip 11 is in the transportation path. These indicators 5A to 5D can be discrete LEDs or grouped together in a single LCD device. The remaining ink levels and paper detection status can thus be presented in a thin display device such as a liquid crystal display device or plasma display device.

The control unit 110 controls overall operation of the printer controller 100. The control unit 110 has a first color level detector 111 and second color level detector 112. These level detectors 111, 112 can be rendered using a computer program and IC logic device, for example, and are described in further detail below.

The communication interface 120 handles communication with the host 20. The communication interface 120 receives print data from the host 20 and sends a printing completion report, for example, to the host 20 using a USB interface or other known communication protocol. The communication interface 120 and host 20 could be connected by wire or wirelessly. The communication interface 120 could alternatively be a LAN (local area network) port enabling a plurality of hosts 20 to share the printer 1 over a network connection.

The receive buffer 130 temporarily stores print data received from the host 20. Commands contained in print data received in the receive buffer 130 are passed to the control unit 110. A hard disk drive or other secondary storage device could also be provided to prevent buffer overflow problems.

The image processing unit 140 generates the image data for printing (print data) based on the print data stored in the receive buffer 130. The image processing unit 140 produces binary or multi-valued print data by running specific image processes such as color conversion, interpolation, enlargement/reduction, rotation, and halftoning. The image processing unit 140 generates print data for each print color.

The output buffer 150 temporarily stores the print data generated by the image processing unit 140. The output buffer 150 has a first output buffer area 151 for storing print data for a first color, and a second output buffer area 152 for storing print data for a second color. Buffer areas 151 and 152 could be rendered using physically discrete memory devices or in a single memory device.

The print engine driver 160 controls the parts of the print engine 200, and outputs specific control signals based on instructions from the control unit 110.

The operating mode selector 170 selects the print mode, for example. In this embodiment of the invention there are two print modes, a monochrome print mode and a color print mode. The operating mode selector 170 could be a DIP switch, and the user could set the DIP switch on/off to select the desired print mode.

Various different sensors can be connected to the control unit 110, including a roll paper detection sensor 180, slip form detection sensor 181, and ink cartridge detection sensor 182.

The roll paper detection sensor 180 detects if roll paper 10 is present. The slip form detection sensor 181 detects if a slip is present. The ink cartridge detection sensor 182 detects if ink cartridges 210 and 220 are present. Other sensors could also be used, including, for example, a sensor for detecting the paper transportation state. If the amount of remaining ink is detected directly, a level sensor or volume sensor could be used as the remaining ink volume sensor.

The print engine 200 can be largely divided into a mechanism for transporting the paper (recording medium), a mechanism for driving the print head 230, and a mechanism for supplying ink. The roll paper 10 or slip 11 is conveyed by the feed roller 250 to the printing position of the print head 230, and each time the print head 230 completes a pass in the main scanning direction, the paper is thereafter advanced a specific distance in the subscanning direction.

The print head 230 discharges a specific volume of ink drops from a plurality of nozzles in the direction of the roll paper 10 or slip 11 supported on the platen 260. The discharged ink drops thus strike the printing surface and form dots. The print head 230 is supported by the carriage 240. The print head 230 travels bidirectionally with the carriage 240 over the printing surface while discharging ink drops from the nozzles.

The printed roll paper 10 or slip 11 is then conveyed by the discharge roller 270 to the corresponding exit 6 or 7, and discharged from the printer 1. If roll paper 10 is used, the roll paper 10 is cut at a specific position by the cutter 280. After the roll paper 10 is cut, the end of the roll paper 10 is rewound a specific distance back inside the printer 1.

The carriage 240, feed roller 250, and platen 260 are driven by a motor not shown in the figures. The print engine driver 160 applies control signals appropriate to the print mode to drive the carriage 240, feed roller 250, and platen 260.

Figure 3:
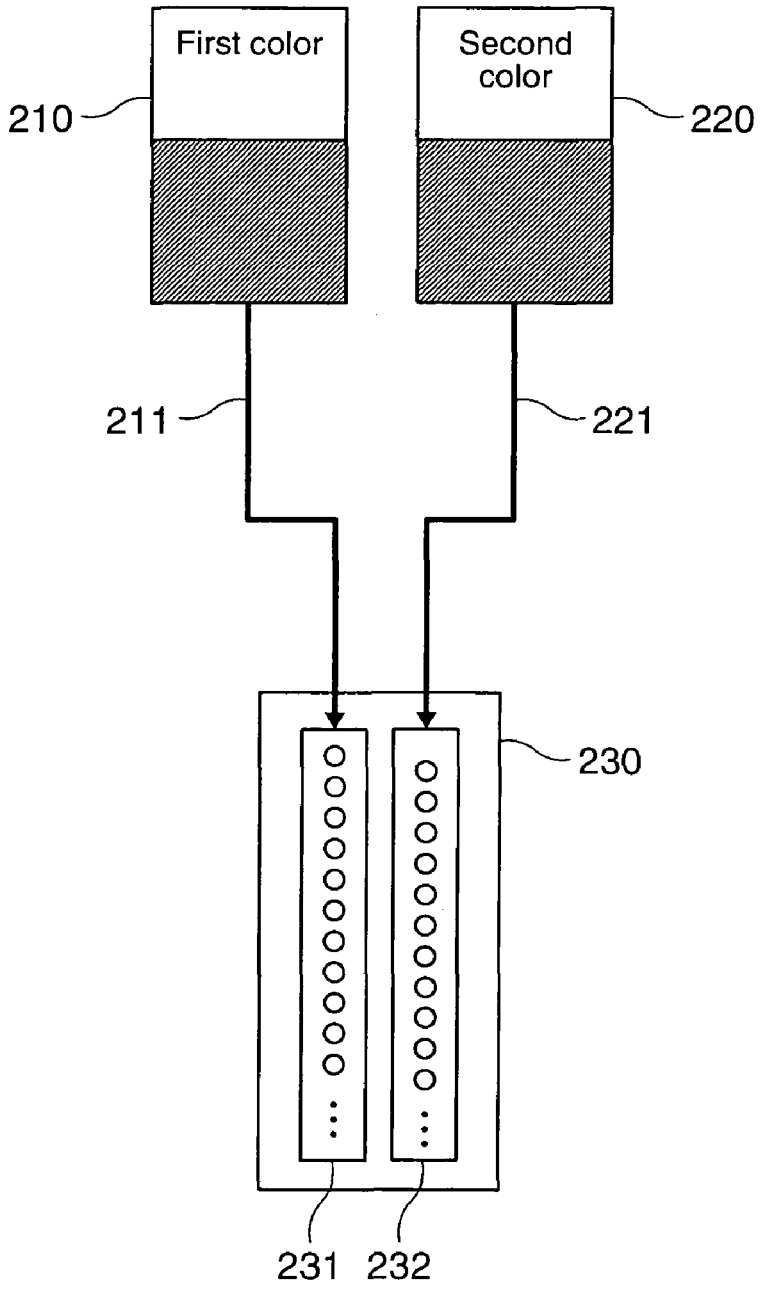
FIG. 3 schematically shows the relationship of the ink cartridge to the print head.

FIG. 3 describes the relationship between the print head 230 and the ink cartridges 210 and 220. The print head 230 has a plurality of nozzle groups corresponding to the individual ink cartridges 210 and 220. In this embodiment of the invention, the print head 230 has a nozzle group for a first color 231 (referred to as first nozzle group 231), and a nozzle group for a second color 232 (second nozzle group 232).

Ink is supplied from the first ink cartridge 210 through the first ink supply path 211 to the first nozzle group 231. Ink is likewise supplied from the second ink cartridge 220 through the second ink supply path 221 to the second nozzle group 232.

The first nozzle group 231 has a plurality of nozzles arrayed in the subscanning direction. The second nozzle group 232 likewise has a plurality of nozzles arrayed in the subscanning direction. Both nozzle groups 231, 232 have the same number of nozzles arranged at the same nozzle pitch. There is preferably a large number of nozzles, such as 64. If the letters on one line can be printed with 32 nozzles, then two lines can be printed in a single pass of the 64 nozzles in the main scanning direction.

As described more fully below, when operating in the monochrome print mode ink cartridges 210 and 220 are ink cartridges of the same color. Black ink cartridges containing black ink, for example, could be installed for both ink cartridges 210 and 220. As a result, the same color of ink is supplied through separate ink supply paths (210-211 and 220-221) to the separate nozzle groups 231 and 232 when operating in the monochrome print mode.

Figure 4:
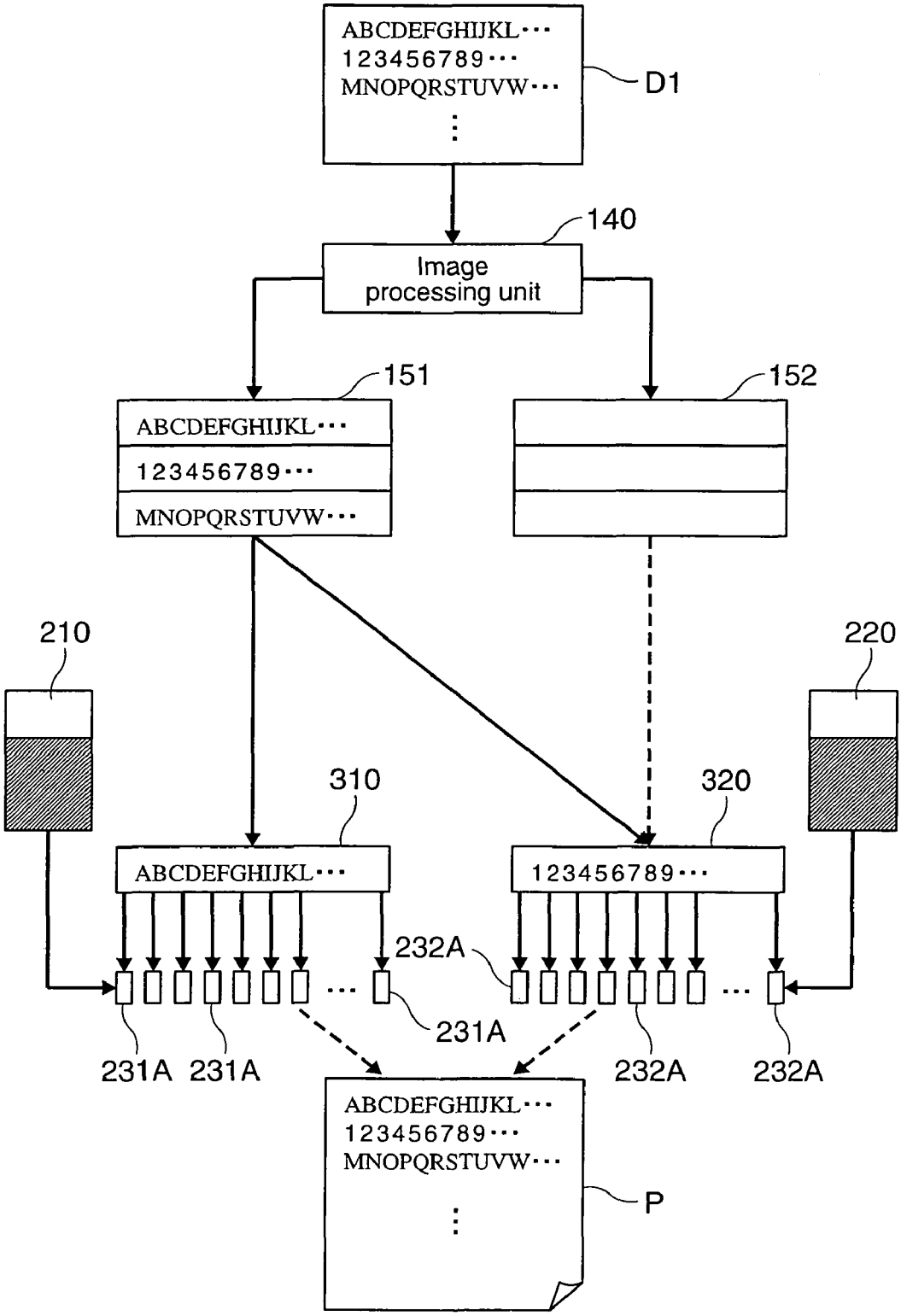
FIG. 4 describes the relationship between the print data and print head.

FIG. 4 schematically shows the flow of print data. In this example print data D1 from the host 20 specifies only the first color, such as to print only black.

The image processing unit 140 produces the print data by running a specific image process based on print data D1. Because this print data D1 specifies only the first color, the print data is generated as print data for the first color. All of this first color print data is stored in first output buffer area 151. Print data is not stored in the second output buffer area 152 because the second color is not used in the print data D1 and there is therefore no print data for the second color.

The print head 230 has a first head buffer 310 and a second head buffer 320. The first head buffer 310 stores print data for the first color and is connected to the first output buffer area 151. The second head buffer 320 likewise stores second color print data and is connected to both the second output buffer area 152 and first output buffer area 151.

The first color print data stored in first output buffer area 151 is transferred at a specific timing to the first head buffer 310. When print data is stored in the first head buffer 310, the drive element 231A for each nozzle is driven to discharge ink drops from each corresponding nozzle. The drive element 231A could be a piezoelectric element or a thermal element. The drive elements 231A are driven, for example, to discharge ink from the nozzle when a 1 bit is input, and to not discharge ink from the nozzle when a 0 bit is input. Ink drops of a volume corresponding to the gray level can be similarly discharged from the nozzles when multivalue data is used.

When print data is stored in second head buffer 320, the drive elements 232A are driven according to the print data in the same way as the drive elements are driven based on print data in the first head buffer 310 to discharge a specific volume of ink from the nozzles. In the monochrome print mode print data is transferred from the first output buffer area 151 to the second head buffer 320. In the color print mode print data is transferred from the second output buffer area 152 to the second head buffer 320.

Regardless of from where the print data arrives, the drive elements 232A of the second nozzle group 232 are driven to print the print data in the second head buffer 320 (i.e., whether the data was passed from the first output buffer area 151 or second output buffer area 152). In the monochrome print mode the user has installed the ink cartridges of the same color for both ink cartridges 210 and 220. The color specified by the host 20 is thus also printed when printing using second nozzle group 232.

By thus alternately writing the print data from first output buffer area 151 to first head buffer 310 and second head buffer 320 for each pass of the print head 230 in the main scanning direction, first color print data can be printed using two nozzle groups 231 and 232.

In the example shown in FIG. 4, the first line of print data "ABCDEFGHIJKL . . . " is stored to the first head buffer 310 and printed by the first nozzle group 231. The second line of print data "123456789 . . . " is stored in the second head buffer 320 and printed by the second nozzle group 232. The third line of print data "MNOPQRSTUVW . . . " is then stored in the first head buffer 310 again and printed by the first nozzle group 231.

The print data stored in the first output buffer area 151 is thus alternately supplied to the first head buffer 310 and second head buffer 320 for each pass of the print head 230 in the main scanning direction. If multiple lines can be printed in one main scanning pass, print data for those multiple lines is transferred as the data for one pass of the print head to the first head buffer 310 and second head buffer 320.

By thus distributing the first color print data to head buffers 310 and 320, the printing paper P can be printed using ink from both ink cartridges 210 and 220. Ink can thus be consumed substantially equally from ink cartridges 210 and 220 so that both ink cartridges 210 and 220 are replaced at the same time. As a result, the ink cartridges are replaced half as frequently as when printing the first color print data using only the first ink cartridge 210.

If the capacity of the ink cartridges 210 and 220 is different, the print data can be allocated proportionally to the capacity of the ink cartridges.

Figure 5:
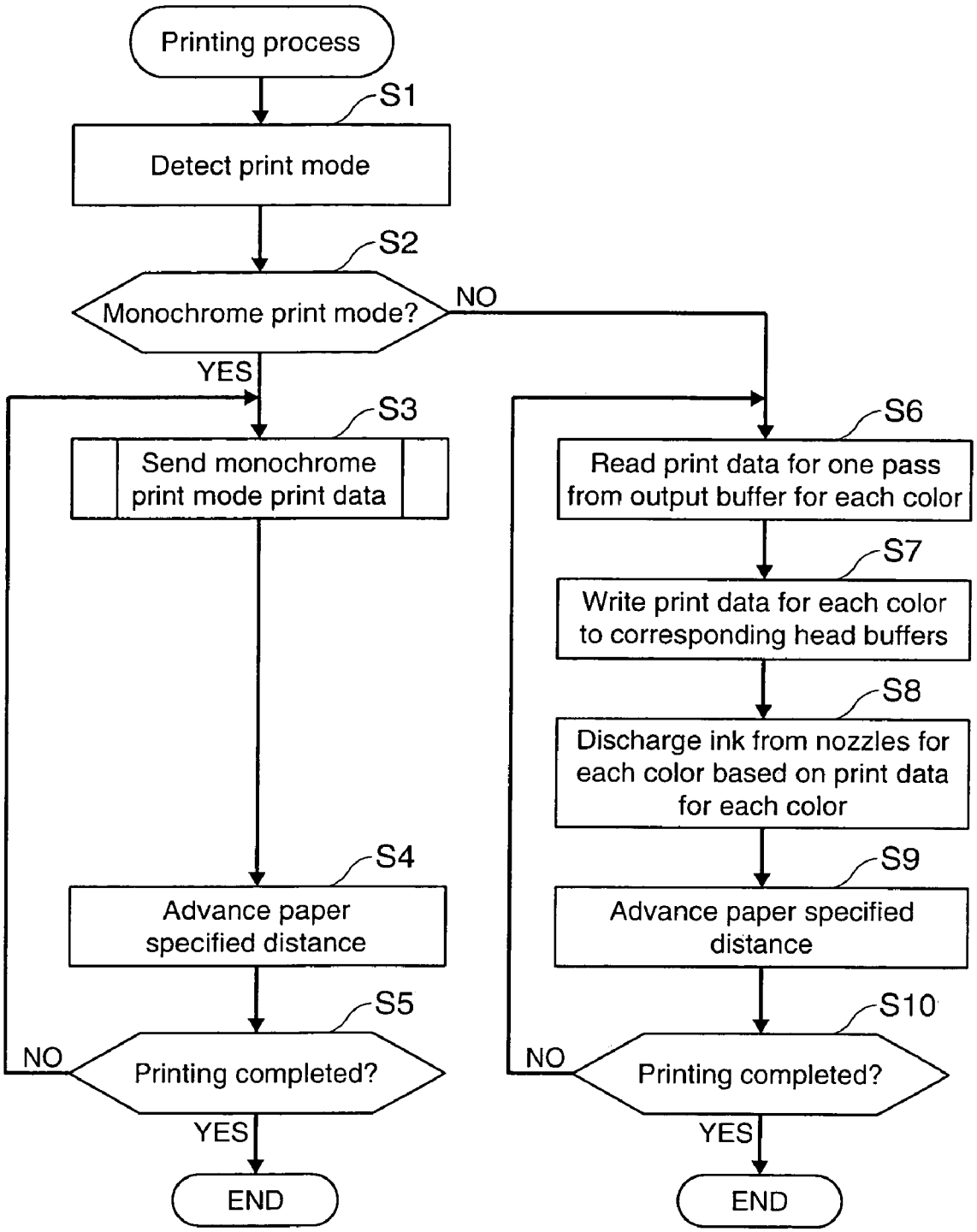
FIG. 5 is a flow chart of the overall printing process.

FIG. 5 is a flow chart describing the overall printing process. To start the printing process the printer 1 first detects the print mode (S1). As described above, the user can select either the monochrome print mode or the color print mode by asserting a mode selection command from the operating mode selector 170 or host 20.

If the monochrome print mode is selected (S2 returns Yes), the print data is processed in the monochrome print mode (S3). The print data transfer process in this monochrome print mode is further described below.

When one pass in the main scanning direction ends, the printer 1 advances the printing paper a specific distance (S4) and then determines if printing has been completed (S5). Steps S3 and S4 repeat until printing is completed.

If the color print mode is selected (S2 returns No), the printer 1 reads print data for one pass in the main scanning direction from both color output buffers 151, 152 (S6) and sends the print data to the corresponding head buffers 310 and 320 (S7). More specifically, the print data read from first output buffer area 151 is sent to first head buffer 310, and the print data read from second output buffer area 152 is sent to second head buffer 320.

The nozzle groups 231, 232 then discharge a specific volume of ink drops from each nozzle based on the print data stored in the corresponding head buffers 310 and 320 (S8), thus printing one or a plurality of lines.

The paper is then advanced a specific distance as described in the monochrome print mode (S9) and whether printing has been completed is determined (S10). Steps S6 to S9 then repeat until printing is completed.

Figure 6:
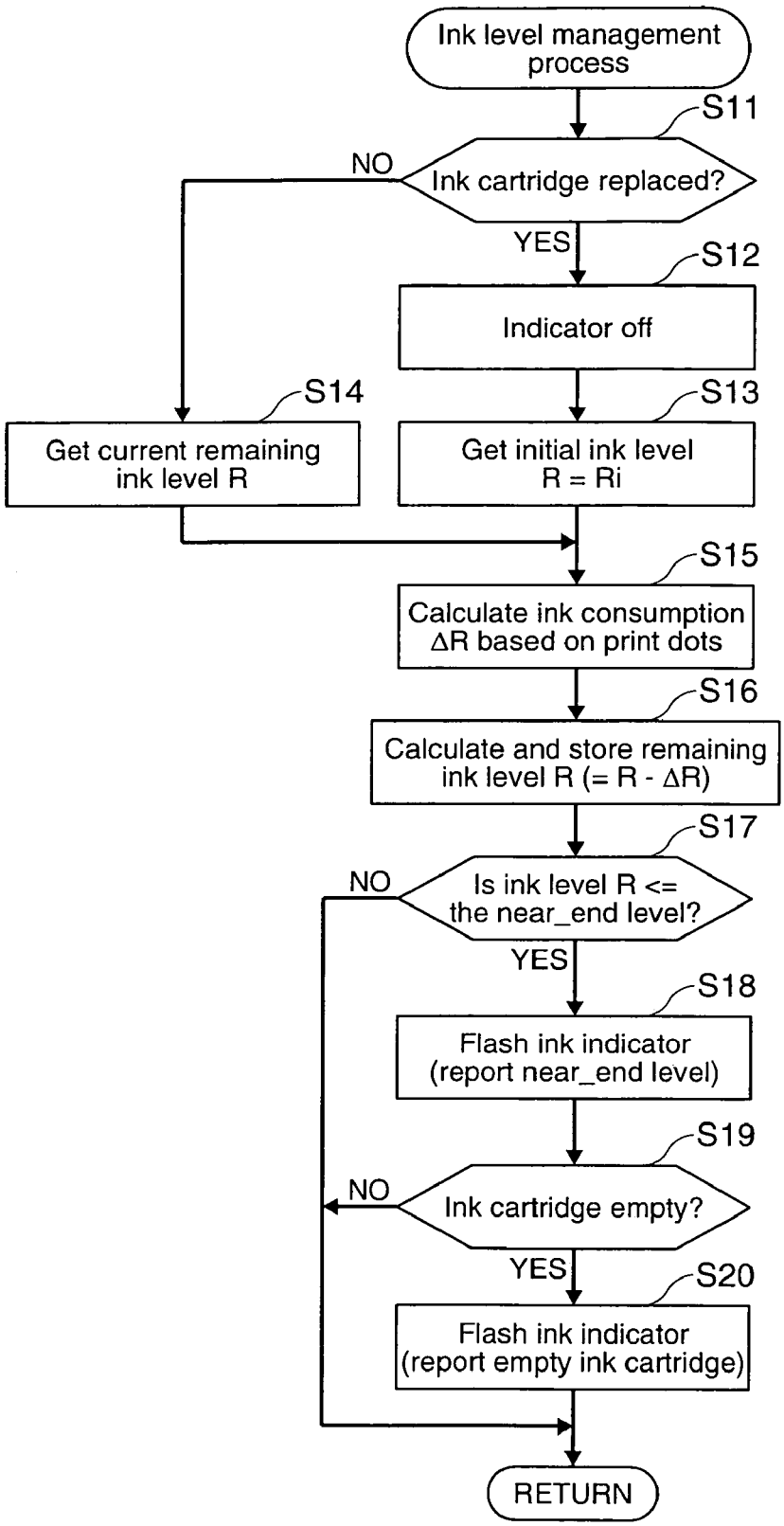
FIG. 6 is a flow chart of the remaining ink level management process.

FIG. 6 is a flow chart of the remaining ink level management process. This process indirectly detects the remaining ink level by calculating how much ink is consumed during printing as described below.

The process shown in FIG. 6 is applied separately to ink cartridges 210 and 220. For brevity, therefore, the remaining ink level management process is described below with reference to the first ink cartridge 210. The remaining ink level of the second ink cartridge 220 is managed in the same way, and description thereof is thus omitted below.

The printer 1 monitors whether the ink cartridge 210 was replaced (S11). If the first ink cartridge 210 was replaced (S11 returns Yes), the first color indicator 5A is turned off (S12). The first color indicator 5A is driven to flash when the ink level in the first ink cartridge 210 reaches the near_end level, and to light steady when the first ink cartridge 210 is empty. The user can thus know if the ink supply is low or exhausted from the state of the indicator. When the first ink cartridge 210 is then replaced, the indicator is turned off to cancel this warning display.

If the ink cartridge was replaced (S11 returns Yes), the printer 1 sets the remaining ink level R to the initial ink level Ri (S13). This initial ink level Ri is the amount of ink contained in a new ink cartridge 210, and is preferably stored in the printer controller 100. Alternatively, a memory device could be disposed to the ink cartridge 210, the initial ink level Ri could be written to this memory device, and the printer 1 could read the initial ink level Ri from the memory device.

If the first ink cartridge 210 was not replaced (S81 returns No), the printer 1 reads the most recently updated remaining ink level, that is, remaining ink level R, from memory (not shown in the figure) in the printer 1 (S14).

The printer 1 monitors printing and calculates the amount of ink ΔR consumed by printing based on the number of dots that are printed and the volume of ink required to form each dot (S15), for example. If ink is discharged in a non-printing area as part of a maintenance procedure, for example, the amount of ink consumed by the maintenance procedure is also included in this ink consumption ΔR value.

The printer 1 then subtracts ink consumption ΔR from remaining ink level R and saves the result as the new remaining ink level R (=R−ΔR) (S16). The printer 1 then compares this newly calculated remaining ink level R with the preset near_end level to determine if the remaining ink level R has dropped to or below the near_end level (S17).

If the remaining ink level R is greater than the near_end level (S17 returns No), the ink level in the ink cartridge 210 has not reached the near_end level, this process therefore ends, and the process repeats from step S11 at a specific time. This specific time is, for example, before the start of or after the end of each pass of the print head in the main scanning direction.

If the remaining ink level R is less than or equal to the near_end level (S17 returns Yes), the first ink cartridge 210 is in the near_end state, that is, there is very little ink left in the cartridge. When the printer 1 thus detects that the first ink cartridge 210 is nearly empty, the printer 1 causes the first color indicator 5A to blink and thereby report to the user that the ink supply is near the end (S18).

The printer 1 then determines if the remaining ink level R is effectively zero, and thus monitors if the ink cartridge 210 is effectively empty (R=0) (S19). If the ink cartridge is not empty (S19 returns No), the printer 1 terminates the remaining ink level management process and repeats this process from step S11 at a specific time.

If printing continues without replacing the first ink cartridge 210, the remaining ink level R in the first ink cartridge 210 will continue to decrease and go to zero, thus causing the first ink cartridge 210 to go from the near_end level to the empty level (S19 returns Yes). When the printer 1 detects that the ink cartridge is empty, the printer 1 drives the first color indicator 5A to inform the user that the first ink cartridge 210 is empty (S20) by, for example, driving the indicator to blink in a different pattern or light in a different color from that used to signal the near_end level.

A certain amount of time, which varies according to the print volume, is required to go from the near_end level to the empty level. This enables the user, for example, to ready a new ink cartridge 210 after confirming that the ink cartridge has reached the near_end level so that the ink cartridge can be replaced when the ink cartridge goes empty.

Figure 7:
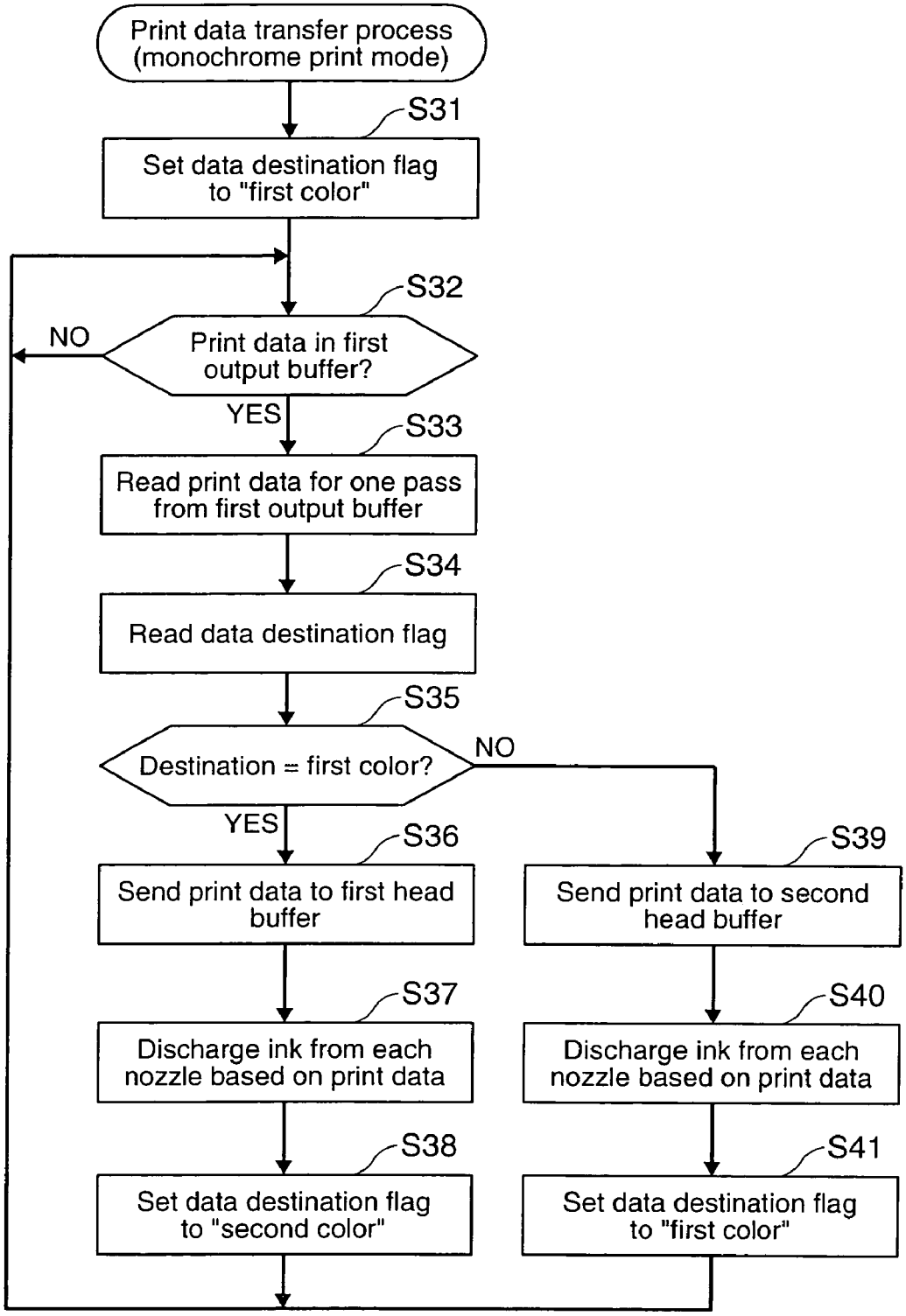
FIG. 7 is a flow chart showing the print data transfer process in the monochrome print mode.

FIG. 7 is a flow chart of the print data transfer process in the monochrome print mode shown in step S3 in FIG. 5. For brevity this process is described as transferring print data with no relationship to the subscanning operation (paper feeding), but in practice the paper is advanced after each pass of the print head in the main scanning direction. As a result, the main scanning and subscanning operations are alternately repeated each time printing one pass of the print head is completed. During the monochrome print mode the first color print data is alternately transferred to the first head buffer 310 and second head buffer 320 for each pass in the main scanning direction.

When the monochrome print mode starts the printer 1 sets the data destination flag to "first color" (S31). This data destination flag identifies the head buffer to which the print data is to be transferred. If the data destination flag is set to the "first color," the print data is transferred to the first head buffer 310. If the data destination flag is set to the "second color," the print data is transferred to the second head buffer 320. The data destination flag can be assigned a single bit because it is sufficient to be able to indicate either the first head buffer 310 or second head buffer 320.

The printer 1 then determines if print data is stored in the first output buffer area 151 (S32). If the first color print data output by the image processing unit 140 is stored in the first output buffer area 151 (S32 returns Yes), the printer 1 reads the print data for one pass from the first output buffer area 151 (S33).

The printer 1 then reads the data destination flag (S34) and determines if the print data is to be sent to the first head buffer 310 or second head buffer 320 (S35). If the data destination flag is set to the first color (S35 returns Yes), the printer 1 sends the first color print data for one pass read from the first output buffer area 151 to the first head buffer 310 (S36).

When the print data is stored in the first head buffer 310, the drive elements 231A of the first nozzle group 231 are driven according to the print data to discharge ink drops from the nozzles of the first nozzle group 231 (S37). When one main scanning pass is thus completed, the printer 1 changes the data destination flag to the "second color" (S38).

Control then loops back to step S32, the printer 1 determines if first color print data is stored in the first output buffer area 151, reads print data for one pass (S33), and reads the data destination flag (S34). Because the data destination flag was set to the "second color" in step S38, step S35 returns No and control thus goes to step S39.

This causes the printer 1 to send the print data read from the first output buffer area 151 for one pass of the print head to the second head buffer 320 (S39). The drive elements 232A of the second nozzle group 232 are thus driven according to the print data to discharge ink drops from the nozzles of the second nozzle group 232 (S40).

When the second nozzle group 232 completes one pass, the data destination flag is set to the "first color" again (S41). The first color print data is thus alternately written to the first head buffer 310 and second head buffer 320 after each pass is completed until printing ends.

Figure 8:
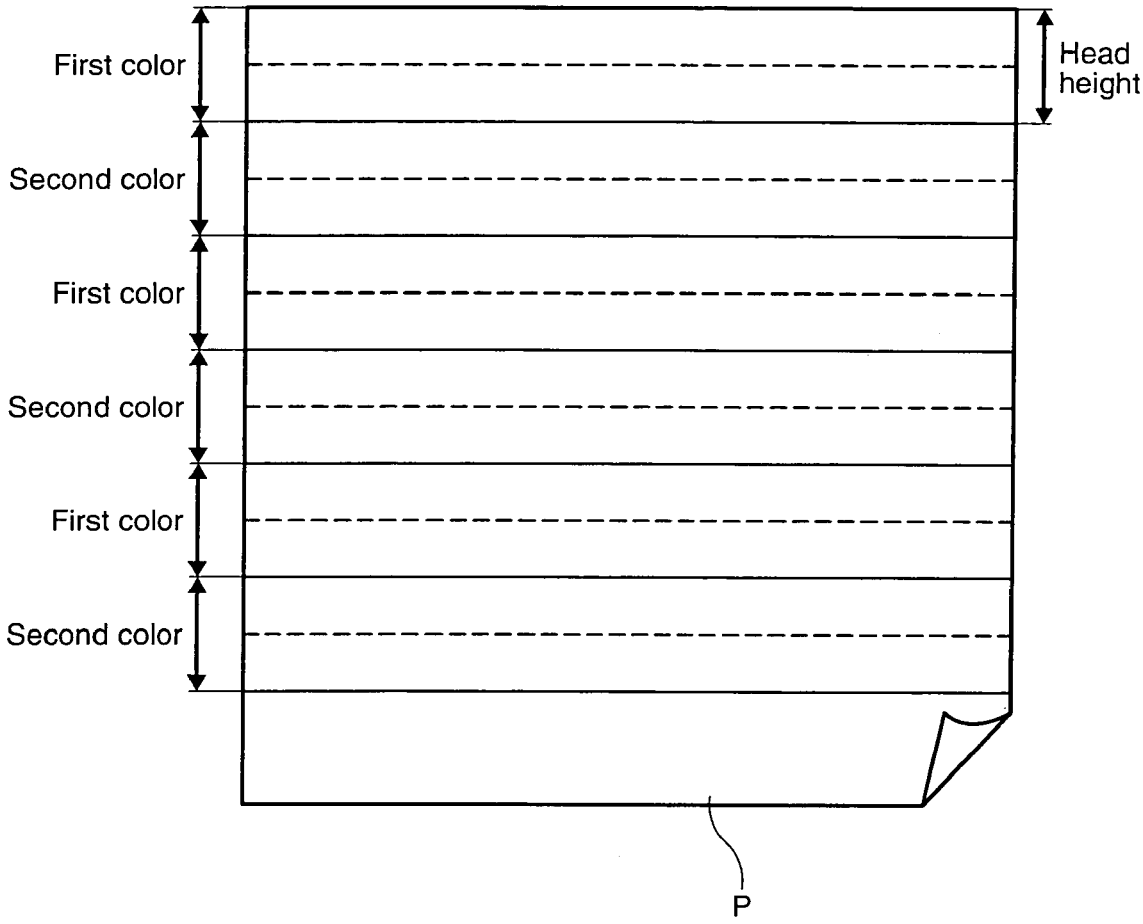
FIG. 8 schematically illustrates printing in the monochrome print mode.

FIG. 8 schematically shows how printing paper P is printed in the monochrome print mode. Two lines are printed in one pass of the print head in the main scanning direction. Printing during the first main scanning pass uses ink supplied from the first ink cartridge 210. Printing during the next main scanning pass uses ink supplied from the second ink cartridge 220.

The user sets the same color of ink in the first ink cartridge 210 and second ink cartridge 220 before printing starts in the monochrome print mode. The same color is thus printed using both ink cartridges 210 and 220. This color is further assumed to be the color specified by the host 20. The first color is assumed to be the color of ink contained in the first ink cartridge 210, and the second color is the color of ink contained in the second ink cartridge 220.

This embodiment of the invention thus supplies at least a portion of the first color print data generated for printing using the first color to print head 230 as second color print data, and this first color print data is thus printed using ink from the second ink cartridge 220.

This embodiment of the invention also distributes the print data stored in the first output buffer area 151 as first color print data or second color print data so that the ink level is substantially the same in both ink cartridges 210 and 220. Both ink cartridges 210 and 220 can thus be used substantially equally so that both ink cartridges become empty at substantially the same time. The ink cartridge replacement frequency can thus be reduced substantially compared with printing using only the first ink cartridge 210. Furthermore, because both ink cartridges 210 and 220 can be replaced at the same time, job productivity and efficiency can be improved.

Print data received from the host 20 is distributed as print data for ink cartridges 210 and 220 inside the printer 1. The host 20 can therefore simply generate print data for the first color without knowing or specifying which ink cartridge is used for printing. The host 20 therefore requires no special functionality and can handle the printer 1 as a simple monochrome printer.

As described above, a printer according to this embodiment of the invention has a monochrome print mode in which a plurality of ink cartridges 210 and 220 each containing the same color of ink are used alternately for printing, and a color print mode that uses ink cartridges 210 and 220 containing different colors of ink. The printer 1 can therefore be set to the monochrome print mode in order to use the printer 1 as a monochrome printer, and can be set to the color print mode in order to use the printer 1 as a color printer. The printer 1 can thus be easily used as desired by means of a simple operation.

This embodiment of the invention alternately distributes print data for one pass of the print head from the first output buffer area 151 to the different head buffers 310 and 320. The ink cartridges 210 and 220 can thus be used substantially equally by means of a relatively simple arrangement, and usability is improved by using the ink cartridges so that both ink cartridges are replaced at the same time.

This embodiment of the invention manages and reports the remaining ink level to the user in two stages, the near_end level and the empty level. Therefore, even if the ink cartridges 210 and 220 reach the empty level at slightly different times in the monochrome print mode, the replacement timing can be synchronized for both ink cartridges.

If, for example, the remaining ink level in the first ink cartridge 210 drops slightly faster than the remaining ink level in the second ink cartridge 220, the first ink cartridge 210 will reach the near_end level first and the second ink cartridge 220 will reach the near_end level sometime later. More particularly, the second ink cartridge 220 will reach the near_end level after the first ink cartridge 210 reaches the near_end level and before the first ink cartridge 210 goes empty. This is because the ink cartridges 210 and 220 are used substantially equally. If the first color indicator 5A signals the near_end level and then the second color indicator 5B also signals the near_end level, the user can replace both ink cartridges 210 and 220 at the same time when either ink cartridge 210 or 220 goes empty first. The delay period between reaching the near_end level and going empty thus absorbs the difference in ink consumption by the ink cartridges 210 and 220 so that both ink cartridges 210 and 220 can be replaced at the same time without wasting ink.

Embodiment 2

A second embodiment of the invention is described next with reference to FIG. 9. This embodiment of the invention distributes the print data to the ink cartridges 210 and 220 while monitoring the remaining ink level in each ink cartridge 210 and 220 in real time.

Figure 9:
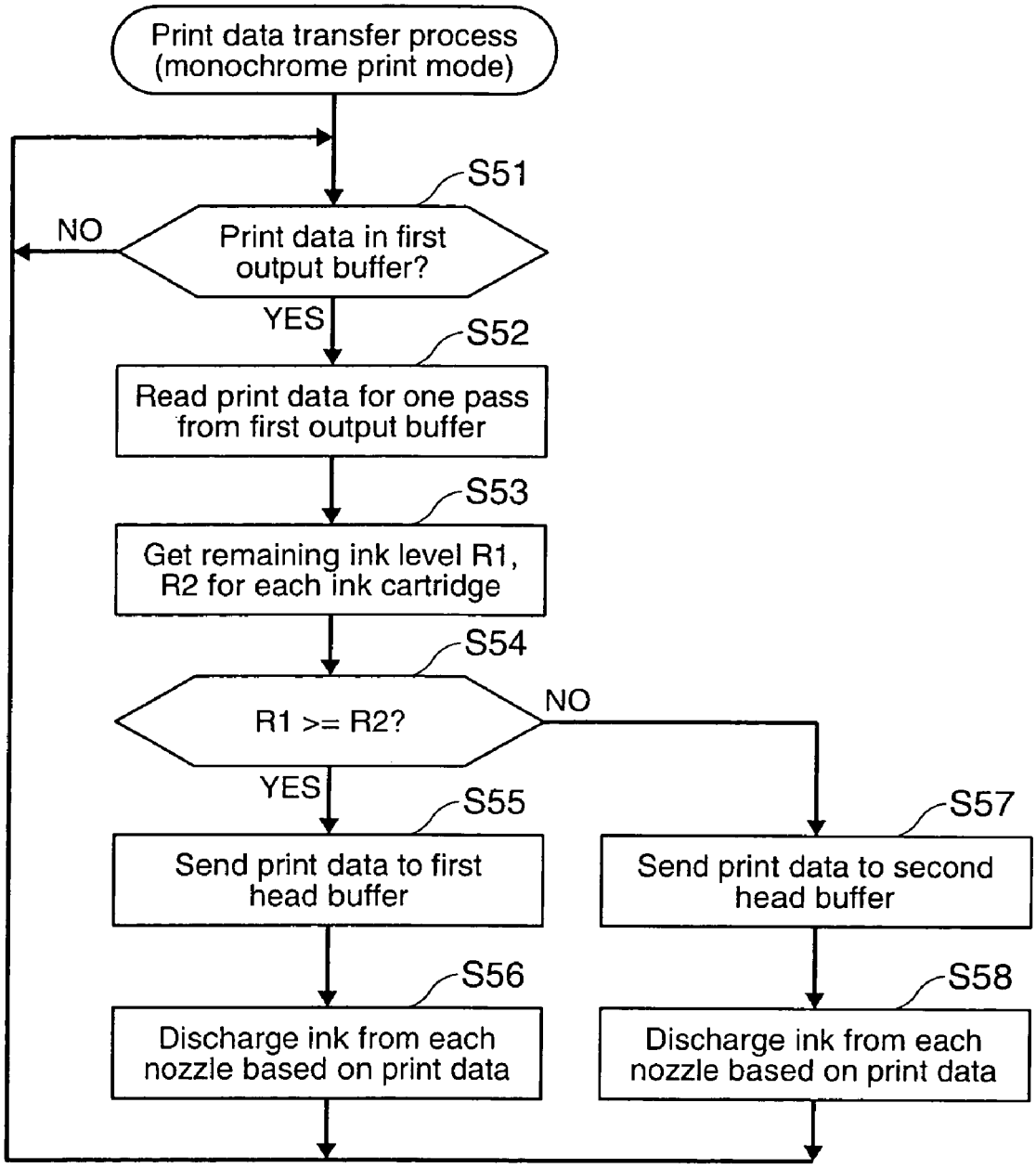
FIG. 9 is a flow chart of the print data transfer process in the monochrome print mode in a second embodiment of the invention.

FIG. 9 is a flow chart of the print data transfer process in the monochrome print mode. The printer 1 first determines if print data is stored in the first output buffer area 151 (S51). If first color print data is stored in the first output buffer area 151 (S51 returns Yes), the printer 1 reads print data for one pass from the first output buffer area 151 (S52) and gets the remaining ink level R1, R2 for each ink cartridge 210 and 220 (S53).

The printer 1 then compares the remaining ink level R1 in the first ink cartridge 210 and the remaining ink level R2 in the second ink cartridge 220, and determines which ink cartridge to use (S54). In this example the printer 1 determines if R1 is greater than or equal to R2.

If R1>=R2 (S54 returns Yes), the first ink cartridge 210 is to be used. The printer 1 therefore transfers and stores print data for one pass in the first head buffer 310 (S55). The printer 1 then drives the first nozzle group 231 to print based on the print data stored in the first head buffer 310 (S56).

However, if R1<R2 (S54 returns No), the second ink cartridge 220 is to be used. The printer 1 therefore transfers the print data to the second head buffer 320 (S57) and drives the second nozzle group 232 to print (S58).

This embodiment of the invention thus distributes the print data for printing while monitoring the remaining ink level R1, R2 in each ink cartridge 210 and 220. Use of the ink cartridges 210 and 220 can thus be switched dynamically according to the printed content and the ink cartridges 210 and 220 can thus be used more equally.

If the number of dots formed in each main scanning pass changes greatly over a period of lines, such as when a long string of characters is printed on lines 1 and 2, a short string of characters is printed on lines 3 and 4, a long string of characters is printed on lines 5 and 6, and a short string of characters is printed on lines 7 and 8, the printer 1 can switch between ink cartridges 210 and 220 so that the remaining ink level R1 and R2 is substantially equal in both ink cartridges.

The present invention has been described with reference to a preferred embodiment of the invention thereof, but the scope of the present invention is not limited to the embodiments of the invention described above. Various changes and modifications will be obvious to one with ordinary skill in the related art, and such changes and modifications are included in the scope of this invention.

For example, the present invention has been described using two ink cartridges, but the invention can also be applied to printers having three or more ink cartridges. The capacity of the ink cartridges is also not necessarily the same in each ink cartridge. The invention is also not limited to printers that can handle both roll paper and individual sheets of paper or other print media.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printing apparatus comprising:

a plurality of ink cartridges each supplying ink;

a print data generating means for generating print data for one or more inks based on input print data;

a print data storage means for storing the print data generated by the print data generating means for each of said inks;

a print head for discharging ink supplied from each ink cartridge from a nozzle group for each of said inks based on the print data for each ink stored in the print data storage means; and a print data supply means for supplying the print data from the print data storage means to the print head;

wherein the print data supply means performs a first switching from supplying a portion of the print data using a first of said inks to the print head to using a second of said inks and performs a second switching from supplying another portion of the print data using the second of said inks to the print head to using the first of said inks so that ink in said plurality of ink cartridges is consumed substantially equally, wherein only one of said first and second switching occurs for each pass of the print head.

2. The printing apparatus according to claim 1, further comprising a selection means for selecting a monochrome print mode or a color print mode; wherein (1) when the monochrome print mode is selected, the color of the one ink is the same as the color of the other ink, and the print data supply means supplies to the print head at least a portion of the print data using the one ink as print data using the other of said inks; and (2) when the color print mode is selected, the color of the one ink and the color of the other ink are different, and the print data supply means supplies print data for each of said inks directly to the print head.

3. The printing apparatus according to claim 2, wherein when the monochrome print mode is selected, the print data supply means supplies print data using the one ink stored in the print data storage means to the print head equally as print data using the one ink and print data using another ink.

4. The printing apparatus according to claim 3, wherein when the monochrome print mode is selected, the print data supply means determines for each main scanning pass of the print head whether to supply the print data using the one ink stored in the print data storage means to the print head as print data using the one ink or print data using the other ink.

5. The printing apparatus according to claim 2, wherein when the monochrome print mode is selected, the print data supply means supplies print data using the one ink stored in the print data storage means to the print head as print data using the one ink or print data using another ink according to a ratio V1/V2 where V1 is a volume of ink in the ink cartridge supplying the one ink and V2 is a volume of ink in the ink cartridge supplying the other ink.

6. The printing apparatus according to claim 2, further comprising a remaining level detection means for detecting an amount of ink remaining in each ink cartridge, wherein:

when the monochrome print mode is selected, the print data supply means supplies print data using the one ink stored in the print data storage means to the print head as print data using the one ink or print data using the other ink so that the remaining volume of the one ink and the remaining volume of the other ink are substantially equal.

7. The printing apparatus according to claim 6, wherein the remaining level detection means detects when the amount of ink is less than a near end level, and when the amount of ink is substantially empty.

8. The printing apparatus according to claim 7, further including an indicator that indicates when the amount of ink is less than a near end level, and when the amount of ink is substantially empty.

9. The printing apparatus according to claim 7, wherein the amount of ink remaining in each ink cartridge is compared, and a cartridge to be used is selected based on said comparison.

10. A printing method for printing using a printing apparatus comprising a plurality of ink cartridges and a print head for discharging ink supplied from each ink cartridge from a nozzle group for each ink, the printing method comprising steps of:

receiving print data from a host device;

generating print data for a plurality of inks based on the received print data;

storing the generated print data separately for each of said inks;

detecting how much ink remains in each ink cartridge; and alternately supplying at least a portion of a specific amount of print data that uses a first ink to the print head as print data that uses a second ink only one time during each pass of the print head so that a remaining volume of the first ink and the remaining volume of the second ink are substantially equal.

11. The printing method according to claim 10, further comprising a step of selecting a monochrome print mode or a color print mode before receiving print data, wherein:

(1) when the monochrome print mode is selected, a color of the one ink is set to the same as a color of the other ink, and supplying the print data to the print head at least a portion of a specific amount of the print data using one of the plurality of ink as print data using another of the plurality of ink so that the remaining volume of the one ink and the remaining volume of the other ink are substantially equal; and (2) when the color print mode is selected, the color of the one ink and the color of the other ink are different, and the print data supplying step supplies print data for each ink directly to the print head.

12. A printing apparatus comprising:

a plurality of ink cartridges each supplying respective ink;

an image processor which generates print data for one or more of said inks based on input print data;

a first and second buffer which store the print data generated by the image processor for each of said inks;

a print head for discharging ink supplied from each ink cartridge from a nozzle group for each ink based on the print data for each ink stored in the first and second buffer; and a supply line which supplies print data from the first and second buffer to the print head;

wherein the supply line performs a first switch from supplying a portion of the print data using a first of said inks to the print head to using a second of said inks and a second switch from supplying another portion of the print data using the second of said inks to the print head to using the first of said inks so that ink in said plurality of ink cartridges is consumed substantially equally, wherein only one of said first and second switches occurs for each pass of the print head.

13. A printing apparatus comprising:

a plurality of ink cartridges each supplying respective ink;

an image processor which generates print data for one or more of said inks based on input print data;

a buffer which stores the print data generated by the image processor for each of said inks;

a print head for discharging ink supplied from each ink cartridge, wherein the print head includes a first head buffer for driving a first group of nozzles connected to a first ink cartridge and a second head buffer for driving a second group of nozzles connected to a second ink cartridge; and a supply line which supplies print data from the buffer to the print head;

wherein the supply line switches from supplying a portion of the print data from the buffer to the first head buffer to supplying a portion of the print data from the buffer to the second head buffer, and switches back to supplying a portion of the print data from the buffer to the first head buffer so that ink in said plurality of ink cartridges is consumed substantially equally, wherein said switching occurs only one time for each pass of the print head.

14. A printing apparatus comprising:

a print data generating means for generating print data for one or more inks based on input print data;

a print data storage means for storing the print data generated by the print data generating means for each of said inks;

a plurality of nozzle groups for discharging ink supplied from a plurality of ink cartridges respectively based on the print data for respective ink stored in the print data storage means; and a print data supply means for supplying the print data from the print data storage means to the plurality of nozzle groups;

wherein the print data supply means switches from supplying a portion of the print data using a first of said inks to the nozzle groups to using a second of said inks and switches from supplying another portion of the print data using the second of said inks to the nozzle groups to using the first of said inks so that ink in said plurality of ink cartridges is consumed substantially equally, wherein said switching occurs only one time for each pass of the print head.

* * * * *